US010156180B2

(12) United States Patent
Wakamoto et al.

(10) Patent No.: US 10,156,180 B2
(45) Date of Patent: Dec. 18, 2018

(54) COOLING STRUCTURE FOR MULTI-CYLINDER ENGINE

(71) Applicant: MAZDA MOTOR CORPORATION, Hiroshima (JP)

(72) Inventors: Shinji Wakamoto, Chofu (JP); Mikimasa Kawaguchi, Hiroshima (JP); Tomohiro Koguchi, Higashihiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 15/375,240

(22) Filed: Dec. 12, 2016

(65) Prior Publication Data

US 2017/0175611 A1 Jun. 22, 2017

(30) Foreign Application Priority Data

Dec. 18, 2015 (JP) ..... 2015-247890

(51) Int. Cl.
*F01P 3/02* (2006.01)
*F02B 75/20* (2006.01)
(Continued)

(52) U.S. Cl.
CPC ..... *F01P 3/02* (2013.01); *F02B 75/20* (2013.01); *F02F 1/14* (2013.01);
(Continued)

(58) Field of Classification Search
CPC ..... F01P 3/02; F02B 75/20; F02B 2075/1816
See application file for complete search history.

(56) References Cited

U.S. PATENT DOCUMENTS 4,455,972 A * 6/1984 Kawakami ..... F01P 3/02 123/41.29
2002/0000210 A1* 1/2002 Shinpo ..... F01P 3/02 123/41.74

(Continued)

FOREIGN PATENT DOCUMENTS

JP 3596438 B2 12/2004
JP 2009-264286 A 11/2009
JP 2015-108346 A 6/2015

OTHER PUBLICATIONS

An Office Action; "Notification of Reasons for Refusal" issued by the Japanese Patent Office on Sep. 26, 2017, which corresponds to Japanese Patent Application No. 2015-247890 and is related to U.S. Appl. No. 15/375,240; with English Translation.

*Primary Examiner* — Jacob Amick
*Assistant Examiner* — Charles Brauch
(74) *Attorney, Agent, or Firm* — Studebaker & Brackett PC

(57) ABSTRACT

A cooling structure includes a block-side water jacket formed in a cylinder block, a head-side water jacket formed in a cylinder head, an introducing portion which introduces a cooling liquid from an end of the cylinder block to the block-side water jacket, a discharging portion which discharges a cooling liquid from the other end of the cylinder block to the head-side water jacket, and a spacer member accommodated in the block-side water jacket, and including a peripheral wall which forms an exhaust-side passage and an intake-side passage between a cylinder bore wall and the peripheral wall. The spacer member includes a distribution adjustment mechanism which distributes a cooling liquid introduced to the block-side water jacket between the exhaust-side passage and the intake-side passage.

14 Claims, 11 Drawing Sheets

(51) Int. Cl.
*F02F 1/14* (2006.01)
*F02B 75/18* (2006.01)

(52) U.S. Cl.
CPC ... *F01P 2003/021* (2013.01); *F01P 2003/024* (2013.01); *F01P 2003/028* (2013.01); *F02B 2075/1816* (2013.01)

(56) References Cited

U.S. PATENT DOCUMENTS

| | | | | |
|---|---|---|---|---|
| 2005/0217615 | A1* | 10/2005 | Matsutani | F01P 3/02 123/41.74 |
| 2009/0266315 | A1 | 10/2009 | Hanai et al. | |
| 2010/0242868 | A1* | 9/2010 | Shikida | F01P 3/02 123/41.79 |

* cited by examiner

COOLING STRUCTURE FOR MULTI-CYLINDER ENGINE

FIELD OF THE INVENTION

The present invention relates to a cooling structure for a multi-cylinder engine.

BACKGROUND ART

Conventionally, there is known, as a cooling structure for a multi-cylinder engine, a structure in which a water jacket is formed in a cylinder block in such a manner as to surround a plurality of cylinders, and a pressurized cooling liquid is introduced from a water pump to the water jacket for cooling an engine.

Further, for the purpose of improving the cooling performance, as disclosed in Japanese Patent No. 3,596,438, disposing a spacer member for separating the inner space of a water jacket within the water jacket is proposed. Specifically, Japanese Patent No. 3,596,438 discloses a configuration, in which a cylinder block includes a water jacket, an introducing portion for introducing a pressurized cooling liquid fed from a water pump to the water jacket, and a discharging portion for discharging the cooling liquid from the water jacket, and a spacer member with a lower portion thereof having a smaller thermal conductivity than an upper portion thereof is disposed within the water jacket. According to this configuration, it is possible to increase the cooling performance with respect to an upper wall of a cylinder bore wall, whose temperature tends to be high as compared with a lower wall of the cylinder bore wall, because the upper wall is close to a combustion chamber as compared with the lower wall. This makes it possible to suppress a temperature difference between portions of the cylinder bore wall in the axial direction thereof, and to suppress non-uniform deformation of the cylinder bore wall.

However, Japanese Patent No. 3,596,438 fails to disclose a configuration for suppressing a temperature difference between an intake side portion of a cylinder block, and an exhaust side portion of the cylinder block, whose temperature tends to be high as compared with the intake side portion due to heat transferred from exhaust gas. As a result, the cylinder bore wall may be non-uniformly deformed due to a temperature difference between the intake side portion and the exhaust side portion of the cylinder block, and fuel economy may be deteriorated as a result of an increase in sliding resistance of pistons.

SUMMARY OF THE INVENTION

In view of the above, an object of the present invention is to provide a cooling structure for a multi-cylinder engine, which enables to appropriately cool an intake side portion and an exhaust side portion of a cylinder block with a simplified configuration.

In view of the above, the present invention is directed to a cooling structure for a multi-cylinder engine including a plurality of cylinders aligned in series. The cooling structure includes a block-side water jacket formed in a cylinder block in such a manner as to surround the plurality of cylinders; a head-side water jacket formed in a cylinder head to be connected to the cylinder block; an introducing portion formed in an end of the cylinder block in the cylinder array direction, and configured to introduce a cooling liquid to the block-side water jacket; a discharging portion formed in the other end of the cylinder block in the cylinder array direction, and configured to discharge the cooling liquid from the block-side water jacket to the head-side water jacket; and a spacer member accommodated in the block-side water jacket in such a manner as to surround a cylinder bore wall defining the plurality of cylinders, and including a peripheral wall facing the cylinder bore wall with a certain gap. An exhaust-side passage and an intake-side passage are formed between the peripheral wall and the cylinder bore wall, the exhaust-side passage located on an exhaust side with respect to the plurality of cylinders and causing a cooling liquid to flow between the introducing portion and the discharging portion, the intake-side passage located on an intake side with respect to the plurality of cylinders and causing a cooling liquid to flow between the introducing portion and the discharging portion. The spacer member includes a distribution adjustment mechanism which distributes a cooling liquid introduced from the introducing portion to the block-side water jacket between the exhaust-side passage and the intake-side passage.

According to the present invention, it is possible to appropriately cool an intake side portion and an exhaust side portion of a cylinder block with a simplified configuration employing a distribution adjustment mechanism of a spacer member.

These and other objects, features and advantages of the present invention will become more apparent upon reading the following detailed description along with the accompanying drawings.

DESCRIPTION OF THE EMBODIMENTS

In the following, a preferred embodiment of the present invention is described in detail referring to the accompanying drawings.

(1) Overall Configuration of Engine

Figure 1:
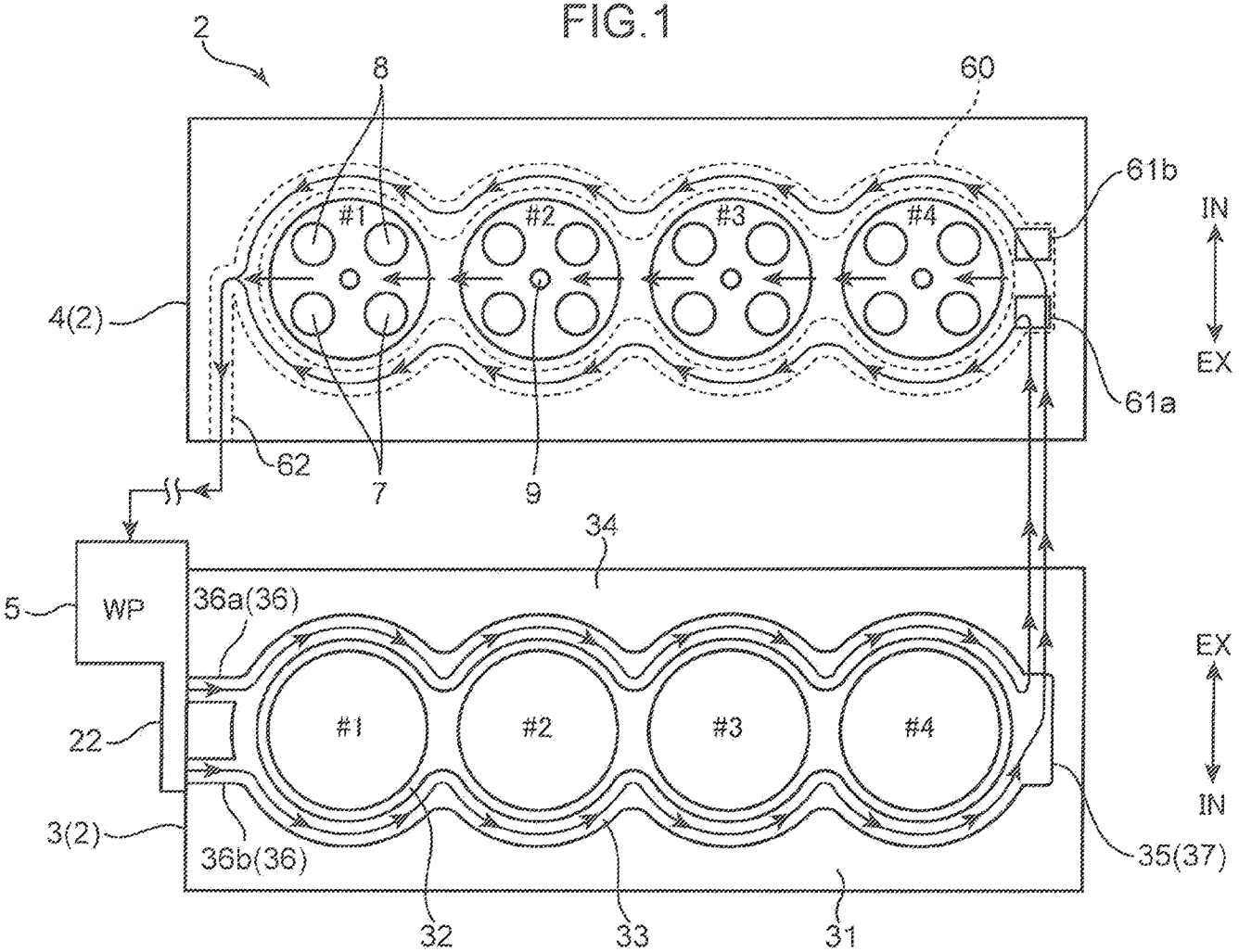
FIG. 1 is a schematic diagram illustrating an overall configuration of a cooling structure for a multi-cylinder engine according to an embodiment of the present invention.

As illustrated in FIG. 1, an engine 2 to which a cooling structure according to an embodiment of the present invention is applied is an in-line 4-cylinder 4-cycle gasoline engine including four cylinders (first to fourth cylinders #1 to #4). The engine 2 is disposed in a transverse posture within an engine room formed in a front portion of a vehicle in a state that the cylinder array direction is aligned with the vehicle width direction (the left-right direction in FIG. 1).

Figure 2:
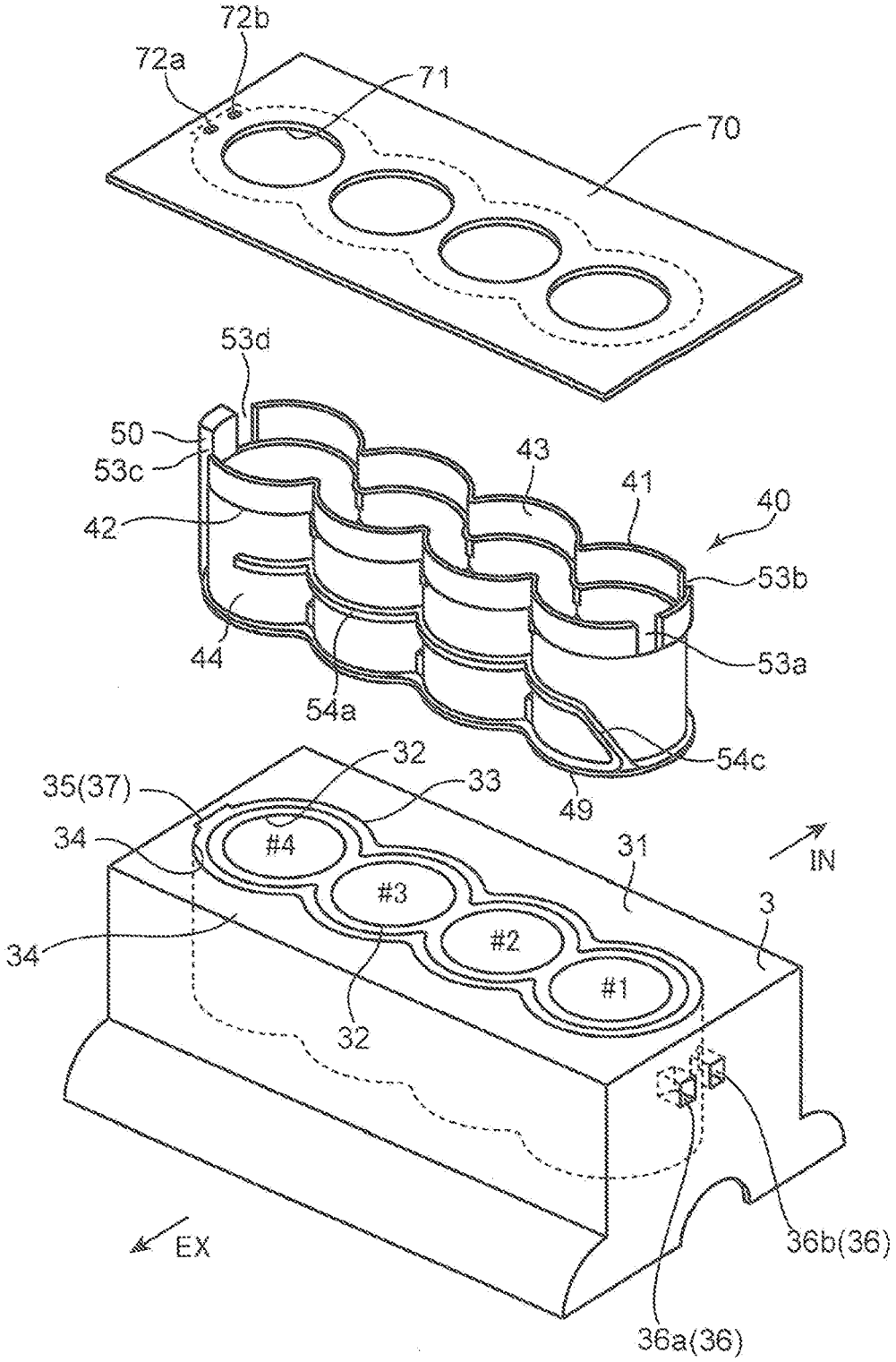
FIG. 2 is an exploded perspective view illustrating a schematic configuration of a cylinder block and peripheral parts thereof.

As illustrated in FIG. 1, the engine 2 includes a cylinder block 3, and a cylinder head 4 to be engaged with a surface (an upper surface) of the cylinder block 3 via a gasket 70 (see FIG. 2). Note that in FIG. 1, illustration of the gasket 70 and a spacer member to be described later is omitted.

An intake device (not illustrated) including an intake manifold is mounted on a surface of the engine 2, specifically, on a surface of the engine 2 on a side in a direction orthogonal to the cylinder array direction. Further, an exhaust device (not illustrated) including an exhaust manifold is mounted on another surface of the engine 2, specifically, on a surface of the engine 2 on the other side in the direction orthogonal to the cylinder array direction. Each of the cylinders of the engine 2 communicates with the intake device and the exhaust device via exhaust ports 7 and intake ports 8 (see FIG. 1) formed in the cylinder head 4.

In each of the drawings, IN indicates an intake side, specifically, a side where the intake ports 8 of the engine 2 are located (a side where the intake device is disposed), and EX indicates an exhaust side, specifically, a side where the exhaust ports 7 of the engine 2 are located (a side where the exhaust device is disposed).

In the following description, a direction in parallel to the central axis of a cylinder is referred to as an up-down direction, a direction on a side in the central axis of a cylinder and oriented from the cylinder block 3 to the cylinder head 4 is referred to as an upward direction, and a direction opposite to the upward direction is referred to as a downward direction. Further, a position in the up-down direction may be referred to as a height position. A radial direction of a cylinder is referred to as a bore radial direction. An inner side in the bore radial direction may be simply referred to as an inner side, and an outer side in the bore radial direction may be simply referred to as an outer side. A direction orthogonal to the cylinder array direction is referred to as an intake-exhaust direction.

Note that FIG. 1 illustrates a state that the cylinder block 3 is viewed from above, and the cylinder head 4 is viewed from below. Therefore, the positional relationship between the intake side and the exhaust side is reversed with respect to the cylinder block 3 and the cylinder head 4. The exhaust ports 7 and the intake ports 8 are formed in the cylinder head 4 in such a manner that each two exhaust ports 7 and each two intake ports 8 are opened toward each cylinder, and a mounting hole 9 for mounting an ignition plug or a fuel injection valve is formed in the central portion of each cylinder.

As illustrated in FIG. 1 and FIG. 2, a block-side water jacket 33 opened in the upward direction is formed in the cylinder block 3. A head-side water jacket 60 communicating with the block-side water jacket 33 is formed in the cylinder head 4 via a discharge portion 37 and the like to be described later. The cylinder block 3 and the cylinder head 4 are cooled by a cooling liquid circulating through the block-side water jacket 33 and the head-side water jacket 60. Note that in the following description, the block-side water jacket 33 and the head-side water jacket 60 are respectively abbreviated as the block-side jacket 33 and the water-side jacket 60.

A cooling liquid discharged from the head-side jacket 60 is refluxed to the block-side jacket 33 through external passing members such as various pipes and radiators. A water pump 5 for feeding a pressurized cooling liquid flowing from the external passing members to the block-side jacket 33 is mounted on the cylinder block 3. Unillustrated flow switching valves for switching a circulation path of a cooling liquid are provided on the cylinder block 3 or the cylinder head 4.

Note that one of the flow switching valves is provided on a discharging portion 62 of the cylinder head 4 to be described later. Opening or closing the flow switching valve according to an operating condition of the engine 2 makes it possible to discharge a cooling liquid from the head-side jacket 60 to the external passing members, and consequently makes it possible to allow flowing of a cooling liquid or stop flowing of a cooling liquid within the block-side jacket 33 and the head-side jacket 60. For instance, when the temperature of the engine 2 is intended to increase in an early stage during a warm-up operation, closing the valve to stop flowing of a cooling liquid makes it possible to prevent cooling of the engine 2 by the cooling liquid.

In the following, each of the constituent elements of the engine 2 is described in detail.

(2) Cylinder Block

As illustrated in FIG. 1, FIG. 2, FIG. 6, and FIG. 7, the cylinder block 3 includes a cylinder bore wall 32 which defines the cylinders #1 to #4, the block-side jacket 33, an introducing portion 36 for introducing a cooling liquid to the block-side jacket 33, and a discharging portion 37 for discharging a cooling liquid from the block-side jacket 33.

The cylinder bore wall 32 includes four tubular wall portions which define the cylinders #1 to #4. The cylinder bore wall 32 is formed by integrally connecting the wall portions in such a manner that the wall portions continue in the cylinder array direction.

The block-side jacket 33 is a space through which a cooling liquid is allowed to flow. The block-side jacket 33 is formed in the cylinder block 3 in such a manner as to surround the four cylinders #1 to #4. Specifically, the block-side jacket 33 is formed between the outer surface of the cylinder bore wall 32, and the inner surface of an outer wall 34 (corresponding to an outer wall of a block-side water jacket of the present invention), which surrounds the cylinder bore wall 32 with a certain gap. In the following description, the outer wall 34 of the block-side jacket 33 is referred to as a block outer wall 34.

The block-side jacket 33 is a so-called open deck water jacket, which is opened to an upper surface 31 of the cylinder block 3. The block-side jacket 33 is formed in a region corresponding to a moving range of pistons (not illustrated) which reciprocate in the up-down direction, more specifically, in a region corresponding to a range from an upper surface of a piston that is moved to a top dead center position to the upper surface of the piston that is moved to a bottom dead center position. A spacer member 40 for separating the inside of the block-side jacket 33 is disposed within the block-side jacket 33. The details of the spacer member 40 will be described later.

The introducing portion 36 is a through-hole (an introducing port), which is formed in an end of the cylinder block 3 in the cylinder array direction (an end of the cylinder block 3 on the first cylinder #1 side). The introducing portion 36 communicates with a discharge port of the water pump 5 via a guiding portion 22 to be described later. The introducing portion 36 may be constituted by a single introducing port, or may be constituted by a plurality of introducing ports. In the embodiment, the introducing portion 36 is constituted by two introducing ports, specifically, an exhaust-side introducing portion 36*a* located on the exhaust side with respect to an engine centerline, which is a line passing through the centers of the four cylinders, and an intake-side introducing portion 36*b* located on the intake side with respect to the engine centerline. Note that when the introducing portion 36 is constituted by a single introducing port, the introducing port is formed to integrally have a portion located on the exhaust side with respect to the cylinder centerline, and a portion located on the intake side with respect to the cylinder centerline.

The exhaust-side introducing portion 36*a* and the intake-side introducing portion 36*b* are formed in the cylinder block 3 to be away from each other in the intake-exhaust direction. The exhaust-side introducing portion 36*a* and the intake-side introducing portion 36*b* are opened at positions away from each other in the intake-exhaust direction with respect to the engine centerline. The opening area of the exhaust-side introducing portion 36*a*, and the opening area of the intake-side introducing portion 36*b* are set to be substantially equal to each other.

Further, the cylinder block 3 includes a bulging space portion 35 on the other end of the cylinder block 3 in the cylinder array direction (an end of the cylinder block 3 on the fourth cylinder #4 side). The bulging space portion 35 is a space communicating with the block-side jacket 33, and bulging from the block-side jacket 33 to the outer side of the fourth cylinder #4 in the bore radial direction, namely, to the side away from the fourth cylinder #4 in the cylinder array direction. The bulging space portion 35 is opened to the upper surface 31 of the cylinder block 3. The width of the bulging space portion 35 in the intake-exhaust direction is set smaller than the width of the block-side jacket 33 in the intake-exhaust direction, namely, set smaller than the distance from a maximally projected portion of the block-side jacket 33 on the intake side to a maximally projected portion of the block-side jacket 33 on the exhaust side. Further, the depth of the bulging space portion 35 is set equal to the depth of the block-side jacket 33.

Figure 6:
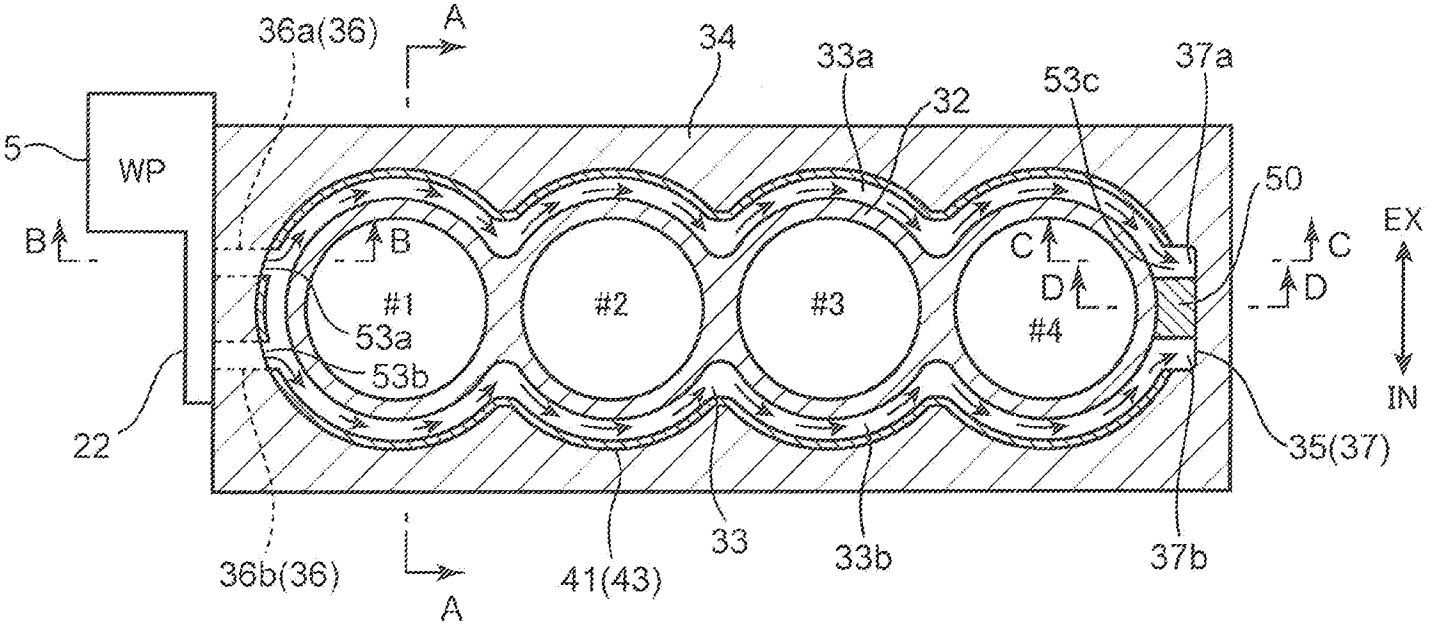
FIG. 6 is a transverse sectional view of the cylinder block in a state that the spacer member is disposed within a block-side water jacket, taken along a line corresponding to a height of an upper portion of the spacer member.

The discharging portion 37 is constituted by an opening portion of an upper end of the bulging space portion 35 (a portion opened to the upper surface 31 of the cylinder block 3). Specifically, the discharging portion 37 is formed in the other end of the cylinder block 3 in the cylinder array direction (an end of the cylinder block 3 on the fourth cylinder #4 side). The discharging portion 37 is formed to communicate between the block-side jacket 33 and the head-side jacket 60. As illustrated in FIG. 6, in the embodiment, the discharging portion 37 includes an exhaust-side discharging portion 37*a* located on the exhaust side, and an intake-side discharging portion 37*b* located on the intake side. The exhaust-side discharging portion 37*a* and the intake-side discharging portion 37*b* are formed by separating the bulging space portion 35 into two spaces in the intake-exhaust direction by a partition wall 50 of the spacer member 40 to be described later. One of the two spaces serves as the exhaust-side discharging portion 37*a*, and the other of the two spaces serves as the intake-side discharging portion 37*b*. The exhaust-side discharging portion 37*a* communicates with the head-side jacket 60 via a communication hole 72*a* of the gasket 70 to be described later and via an exhaust-side introducing port 61*a* of the cylinder head 4 to be described later. The intake-side discharging portion 37*b* communicates with the head-side jacket 60 via a communication hole 72*b* of the gasket 70 to be described later and via an intake-side introducing port 61*b* of the cylinder head 4 to be described later.

(3) Gasket

As illustrated in FIG. 2, the gasket 70 is a seal member disposed between the cylinder block 3 and the cylinder head 4 for sealing between the cylinder block 3 and the cylinder head 4. The material of the gasket 70 is not specifically limited. The material of the gasket 70 may be a metal, for instance. Specifically, the gasket 70 is formed by laminating a plurality of metal plates, and integrally caulking the laminated metal plates at plural positions. The cylinder block 3 and the cylinder head 4 are engaged with each other by a plurality of head bolts (not illustrated) in a state that the gasket 70 is sandwiched between the cylinder block 3 and the cylinder head 4. Note that bolt holes in which the head bolts are engageably received are formed in the cylinder block 3 and the gasket 70. Illustration of the bolt holes is omitted.

The gasket 70 is formed in such a manner that the overall shape of the gasket 70 coincides with the shape of the upper surface 31 of the cylinder block 3. Four circular holes 71 are formed in the gasket 70 at positions corresponding to the four cylinders #1 to #4.

The two communication holes 72*a* and 72*b* passing through the gasket 70 in the thickness direction of the gasket 70 are formed in the other end of the gasket 70 in the cylinder array direction (an end of the gasket 70 on the fourth cylinder #4 side). Each of the communication holes 72*a* and 72*b* communicates between the block-side jacket 33 and the head-side jacket 60. The opening area of the communication hole 72*a* is set larger than the opening area of the communication hole 72*b*.

(4) Spacer Member

A detailed structure of the spacer member 40 to be accommodated in the block-side jacket 33 is described referring to FIG. 2 to FIG. 11.

The spacer member 40 includes a spacer body portion 41, a lower end flange 49, rib portions 54*a* to 54*d*, and the partition wall 50. The spacer member 40 is made of a material, whose thermal conductivity is smaller than the thermal conductivity of the material of the cylinder block 3 (e.g. aluminum alloy). In the embodiment, the spacer member 40 is made of synthetic resin.

Figure 8:
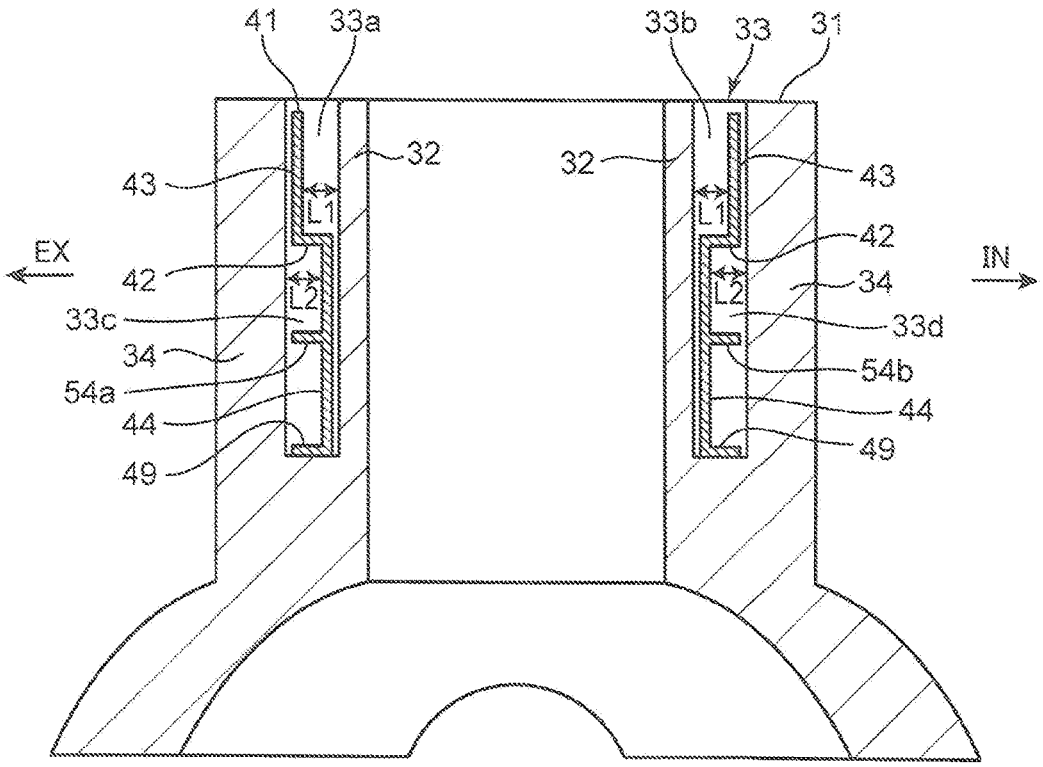
FIG. 8 is a sectional view taken along the line A-A in FIG. 6.
Figure 9:
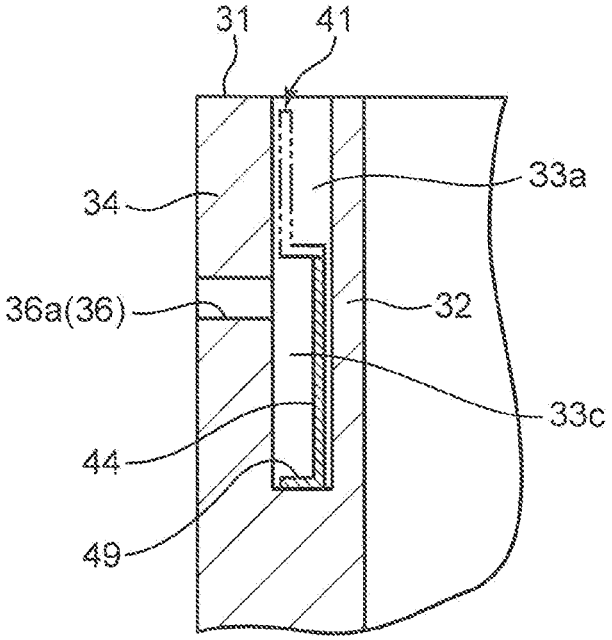
FIG. 9 is a sectional view taken along the line B-B in FIG. 6.
Figure 10:
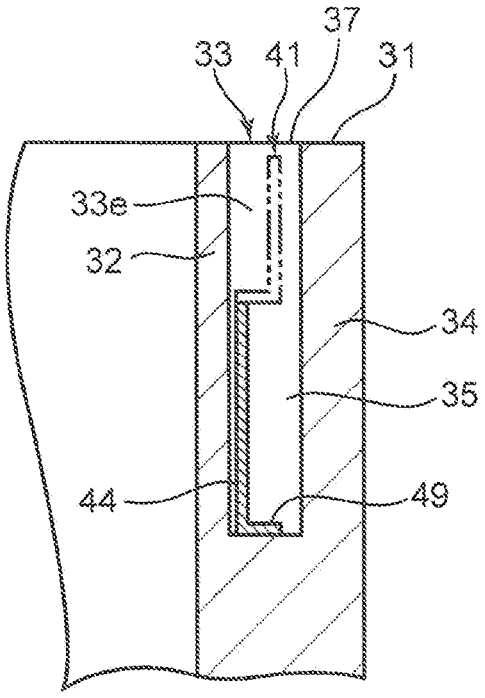
FIG. 10 is a sectional view taken along the line C-C in FIG. 6.

The spacer body portion 41 is a member surrounding the entirety of the outer periphery of the cylinder bore wall 32, which defines the cylinders #1 to #4. The spacer body portion 41 is a tubular member of a shape such that four circles in plan view are connected to each other along the cylinder bore wall 32 while slightly overlapping each other, and the overlapped portions are removed. Specifically, as illustrated in FIG. 2 and FIG. 8, the spacer body portion 41 includes an upper wall 43 (corresponding to a peripheral wall of the present invention) surrounding a part of an upper portion of the cylinder bore wall 32, which defines the cylinders #1 to #4, a step portion 42 continuing to the lower end of the upper wall 43 and projecting radially inwardly, and a lower wall 44 continuing to the inner end of the step portion 42 and formed below the upper wall 43. The spacer body portion 41 has such a tubular shape that the lower wall 44 shrinks inwardly with respect to the upper wall 43. In the embodiment, the upper wall 43 is formed in a region corresponding to about an upper one-third of the spacer body portion 41 in the moving range of an upper surface of a piston in the up-down direction. Note that the height position of the upper wall 43 is not limited to the aforementioned height position. For instance, the upper wall 43 may be formed in a region corresponding to about an upper one-half of the spacer body portion 41 in the moving range of an upper surface of a piston in the up-down direction.

As illustrated in FIG. 8 to FIG. 11, the spacer body portion 41 has a height such that the spacer body portion 41 does not project from the upper surface 31 of the cylinder block 3. In other words, the spacer body portion 41 has a height substantially equal to the depth of the block-side jacket 33, or a height lower than the depth of the block-side jacket 33. In the embodiment, the height of an upper end of the spacer body portion 41 is set substantially equal to the height of the upper surface 31 of the cylinder block 3. The block-side jacket 33 is separated into an inner portion and an outer portion in the bore radial direction by the spacer body portion 41 over the entirety of the block-side jacket 33.

The upper wall 43 is a tubular wall extending in the up-down direction. The upper wall 43 is formed in such a manner that the inner surface thereof faces the upper portion of the cylinder bore wall 32 with a predetermined gap L1 (see FIG. 8), and that the outer surface thereof is proximate to the upper portion of the block outer wall 34 with a distance sufficiently smaller than the gap L1 in a state that the upper wall 43 is disposed within the block-side jacket 33. As illustrated in FIG. 6 and FIG. 8, an exhaust-side passage 33*a* located on the exhaust side with respect to the four cylinders #1 to #4, and an intake-side passage 33*b* located on the intake side with respect to the four cylinders #1 to #4 are formed between the upper wall 43 and the cylinder bore wall 32. Note that the upper wall 43 may be formed to have dimensions such that the upper wall 43 is in close contact with the block outer wall 34 in a state that the upper wall 43 is disposed within the block-side jacket 33.

As illustrated in FIG. 2 to FIG. 6, an exhaust-side opening portion 53*a* and an intake-side opening portion 53*b* are formed in an end of the upper wall 43 in the cylinder array direction, in other words, in an end of the upper wall 43 on the introducing portion 36 side at positions away from each other by a certain gap in the intake-exhaust direction. The exhaust-side opening portion 53*a* and the intake-side opening portion 53*b* are located on the upper side than the exhaust-side introducing portion 36*a* and the intake-side introducing portion 36*b*. Further, the exhaust-side opening portion 53*a* is located on the exhaust side with respect to the engine centerline (a line passing through the centers of the four cylinders), and the intake-side opening portion 53*b* is located on the intake side with respect to the engine centerline. In the embodiment, the exhaust-side opening portion 53*a* and the intake-side opening portion 53*b* are formed into cutouts, each of which extends from the upper end of the upper wall 43 to the step portion 42. The opening area of the exhaust-side opening portion 53*a* is set larger than the opening area of the intake-side opening portion 53*b* so that a large amount of cooling liquid is allowed to flow to the exhaust-side passage 33*a*, as compared with the intake-side passage 33*b*. The exhaust-side opening portion 53*a* and the intake-side opening portion 53*b* correspond to one of the elements of a distribution adjustment mechanism of the present invention.

Further, as illustrated in FIG. 2 to FIG. 6, discharge-side opening portions 53*c* and 53*d* are formed in the other end of the upper wall 43 in the cylinder array direction, in other words, in an end of the upper wall 43 on the discharging portion 37 side to form cutouts, each of which extends from the upper end of the upper wall 43 to the step portion 42. The opening area of the discharge-side opening portion 53*c* located on the exhaust side is set larger than the opening area of the discharge-side opening portion 53*d* located on the intake side. Note that the opening areas of the discharge-side opening portions 53*c* and 53*d* may be substantially equal to each other.

Figure 7:
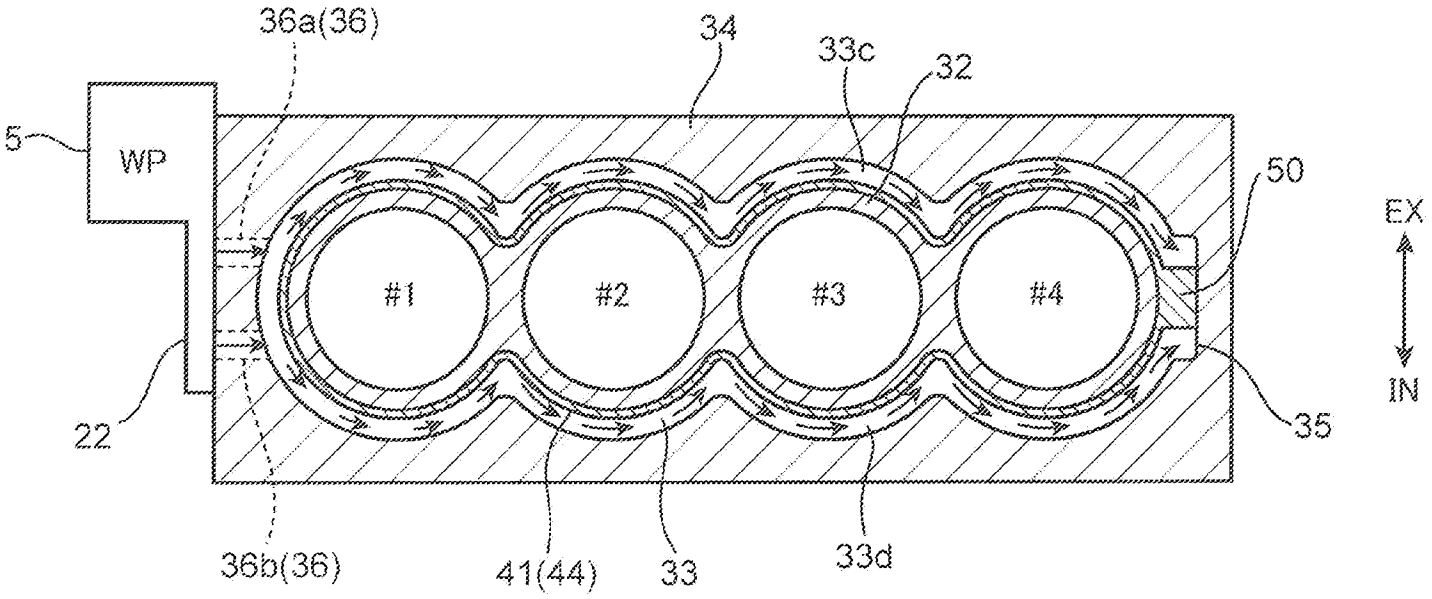
FIG. 7 is a transverse sectional view of the cylinder block in a state that the spacer member is disposed within the block-side water jacket, taken along a line corresponding to a height of a lower portion of the spacer member.

The lower wall 44 is a tubular wall extending in the up-down direction. The lower wall 44 is formed in such a manner that the outer surface thereof faces the block outer wall 34 with a predetermined gap L2 (see FIG. 8), and that the inner surface thereof is proximate to the middle portion of the cylinder bore wall 32 in the up-down direction with a distance sufficiently smaller than the gap L2 in a state that the lower wall 44 is disposed within the block-side jacket 33. As illustrated in FIG. 7 and FIG. 8, an exhaust-side passage 33*c* (corresponding to a lower exhaust-side passage of the present invention), which is located on the exhaust side with respect to the four cylinders #1 to #4, and an intake-side passage 33*d* (corresponding to a lower intake-side passage of the present invention), which is located on the intake side with respect to the four cylinders #1 to #4 are formed between the lower wall 44 and the block outer wall 34 in a state that lower wall 44 is disposed within the block-side jacket 33. Note that the lower wall 44 may be formed to have dimensions such that the lower wall 44 is in close contact with the cylinder bore wall 32 in a state that the lower wall 44 is disposed within the block-side jacket 33.

The dimensional relationship between the gap L1 and the gap L2 is not specifically limited. In the embodiment, the gap L1 and the gap L2 are set to be equal to each other. Alternatively, the gap L1 may be set to a value larger than the gap L2, or the gap L2 may be set to a value larger than the gap L1.

Figure 3:
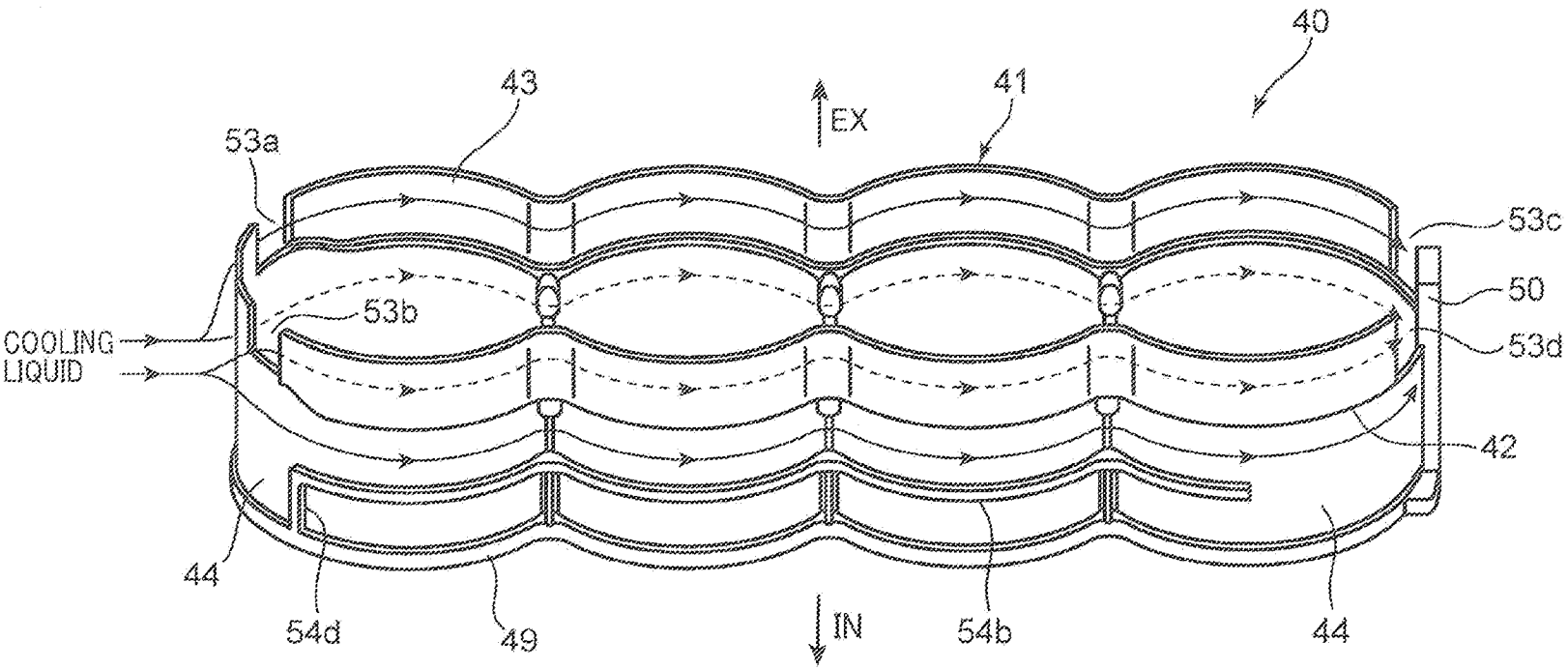
FIG. 3 is a perspective view of a spacer member when viewed from the intake side.

As illustrated in FIG. 3 and FIG. 7, the lower wall 44 is separated into a portion on the exhaust side (an exhaust side portion) and a portion on the intake side (an intake side portion) on the other end of the lower wall 44 in the cylinder array direction. The partition wall 50 is interposed between the exhaust side portion of the lower wall 44, and the intake side portion of the lower wall 44. The exhaust side portion of the lower wall 44 and the intake side portion of the lower wall 44 are integrally formed with the partition wall 50.

As illustrated in FIG. 2 to FIG. 5, the lower end flange 49 is formed to project from the outer surface of the lower end of the spacer body portion 41 toward the block outer wall 34 (to the outer side in the bore radial direction). The lower end flange 49 is formed to surround the lower end of the spacer body portion 41 over the entire periphery of the lower end flange 49. As illustrated in FIG. 8, the spacer member 40 is accommodated within the block-side jacket 33 in a state that the lower end flange 49 is in contact with the bottom surface of the block-side jacket 33.

As illustrated in FIG. 2 to FIG. 7, the partition wall 50 is a rectangular parallelepiped wall extending in the up-down direction. The partition wall 50 corresponds to one of the elements of the distribution adjustment mechanism of the present invention. The partition wall 50 is located between the exhaust side portion of the lower wall 44 and the intake side portion of the lower wall 44 on the other end of the spacer member 40 in the cylinder array direction, extends upwardly from the same height position as the lower end of the lower wall 44, and extends to the same height position as the upper end of the upper wall 43 within the discharging portion 37. The inner surface of the partition wall 50 (the inner surface of the partition wall 50 in the bore radial direction) is made flush with the inner surface of the lower wall 44. Further, the outer surface of the partition wall 50 (the outer surface of the partition wall 50 in the bore radial direction) projects outwardly with respect to the outer surface of the lower wall 44 and the outer surface of the upper wall 43.

As illustrated in FIG. 6 and FIG. 7, the partition wall 50 is disposed within the bulging space portion 35 in a state that the width of the partition wall 50 in the intake-exhaust direction is set smaller than the width of the bulging space portion 35 in the intake-exhaust direction. According to this configuration, the exhaust-side discharging portion 37*a* for discharging a cooling liquid from the exhaust-side passages 33*a* and 33*c* to the head-side jacket 60 is formed in a portion of the bulging space portion 35 on the exhaust side than the partition wall 50; and the intake-side discharging portion 37*b* for discharging a cooling liquid from the intake-side passages 33*b* and 33*d* to the head-side jacket 60 is formed in a portion of the bulging space portion 35 on the intake side than the partition wall 50. Note that in the embodiment, the partition wall 50 is disposed at the middle portion of the bulging space portion 35 in the intake-exhaust direction. The exhaust-side discharging portion 37*a* communicates with the head-side jacket 60 via the communication hole 72*a* of the gasket 70 and via the exhaust-side introducing port 61*a* of the cylinder head 4 to be described later. The intake-side discharging portion 37*b* communicates with the head-side jacket 60 via the communication hole 72*b* of the gasket 70 and via the intake-side introducing port 61*b* of the cylinder head 4 to be described later.

Figure 11:
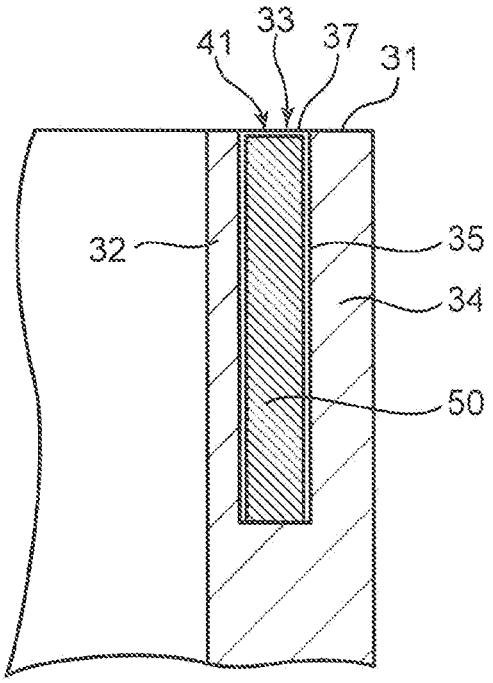
FIG. 11 is a sectional view taken along the line D-D in FIG. 6.

As illustrated in FIG. 11, the outer surface of the partition wall 50 (the outer surface of the partition wall 50 in the bore radial direction) faces the block outer wall 34 in proximity to the block outer wall 34 with a gap sufficiently smaller than the gap L2 or in close contact with the block outer wall 34 over the entire length of the partition wall 50 in a state that the spacer member 40 is disposed within the block-side jacket 33. Further, the inner surface of the partition wall 50 (the inner surface of the partition wall 50 in the bore radial direction) faces the cylinder bore wall 32 in proximity to the cylinder bore wall 32 with a gap sufficiently smaller than the gap L1 or in close contact with the cylinder bore wall 32 over the entire length of the partition wall 50.

As described above, the partition wall 50 is disposed in proximity to or in close contact with the cylinder bore wall 32 and the block outer wall 34 over the entire length of the partition wall 50. This makes it possible to separate the exhaust-side passage 33*a* and the intake-side passage 33*b* from each other in the entirety of the partition wall 50 in the up-down direction, and to separate the exhaust-side passage 33*c* and the intake-side passage 33*d* from each other in the entirety of the partition wall 50 in the up-down direction. Further, this makes it possible to separate the bulging space portion 35 into an exhaust side portion and an intake side portion. Note that the exhaust-side passage 33*a* and the exhaust-side passage 33*c* communicate with each other via the discharge-side opening portion 53*c* located on the exhaust side than the partition wall 50. The intake-side passage 33*b* and the intake-side passage 33*d* communicate with each other via the discharge-side opening portion 53*d* located on the intake side than the partition wall 50.

As illustrated in FIG. 2 to FIG. 5, the rib portions 54*a* to 54*d* are the exhaust-side rib portion 54*a*, the intake-side rib portion 54*b*, the tilted rib portion 54*c*, and the vertical rib portion 54*d*.

Figure 4:
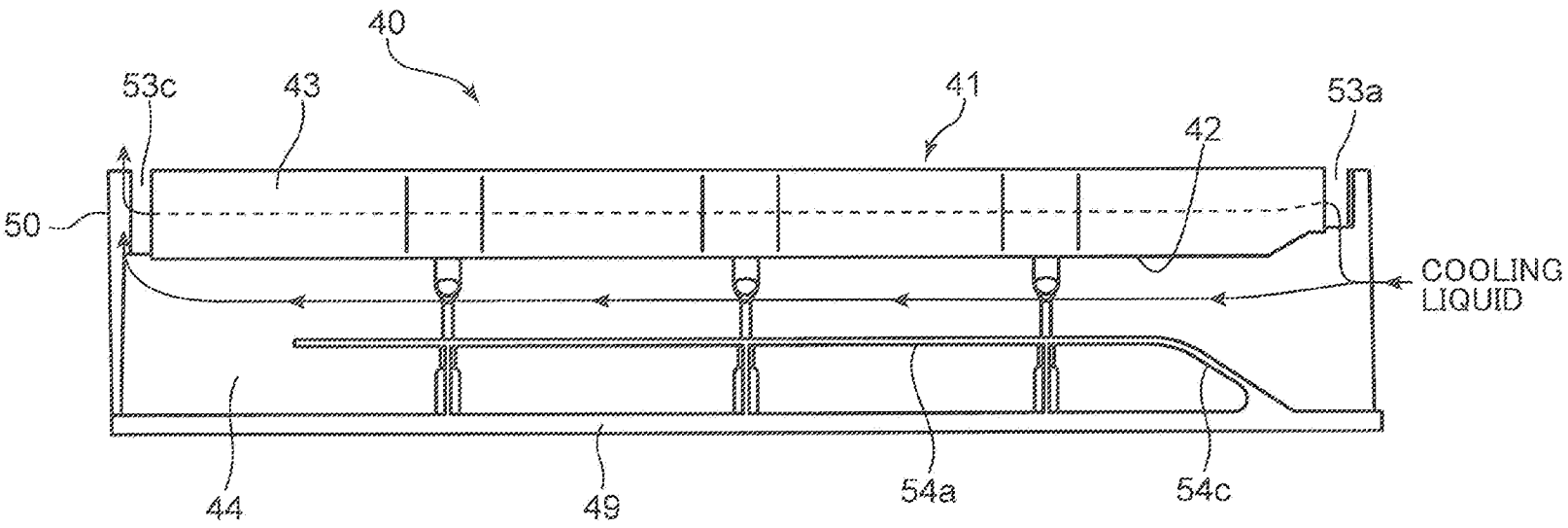
FIG. 4 is a side view of the spacer member when viewed from the exhaust side.

The exhaust-side rib portion 54*a* and the intake-side rib portion 54*b* correspond to a rib portion of the present invention. As illustrated in FIG. 2, FIG. 4, and FIG. 8, the exhaust-side rib portion 54*a* is formed to project from the outer surface of the exhaust side portion of the lower wall 44 outwardly in the bore radial direction, and to extend from the introducing portion 36 side toward the discharging portion 37 side along the lower wall 44 at the middle portion of the lower wall 44 in the up-down direction. The exhaust-side passage 33*c* is formed on the upper side than the exhaust-side rib portion 54*a*. In other words, the exhaust-side rib portion 54*a* defines the range of the exhaust-side passage 33*c* the up-down direction. Note that the exhaust-side rib portion 54*a* and the intake-side rib portion 54*b* are not formed on an end and the other end of the lower wall 44 in the cylinder array direction.

The projection height of the exhaust-side rib portion 54*a* is set substantially equal to a projection amount of the upper wall 43 with respect to the lower wall 44 in the radial direction. According to this configuration, the projection end of the exhaust-side rib portion 54*a* faces the block outer wall 34 in proximity to or in close contact with the block outer wall 34 in a state that the spacer member 40 is disposed within the block-side jacket 33. In the embodiment, the height position of the exhaust-side rib portion 54*a* coincides with the middle portion of the cylinders #1 to #4 in the up-down direction.

Figure 5:
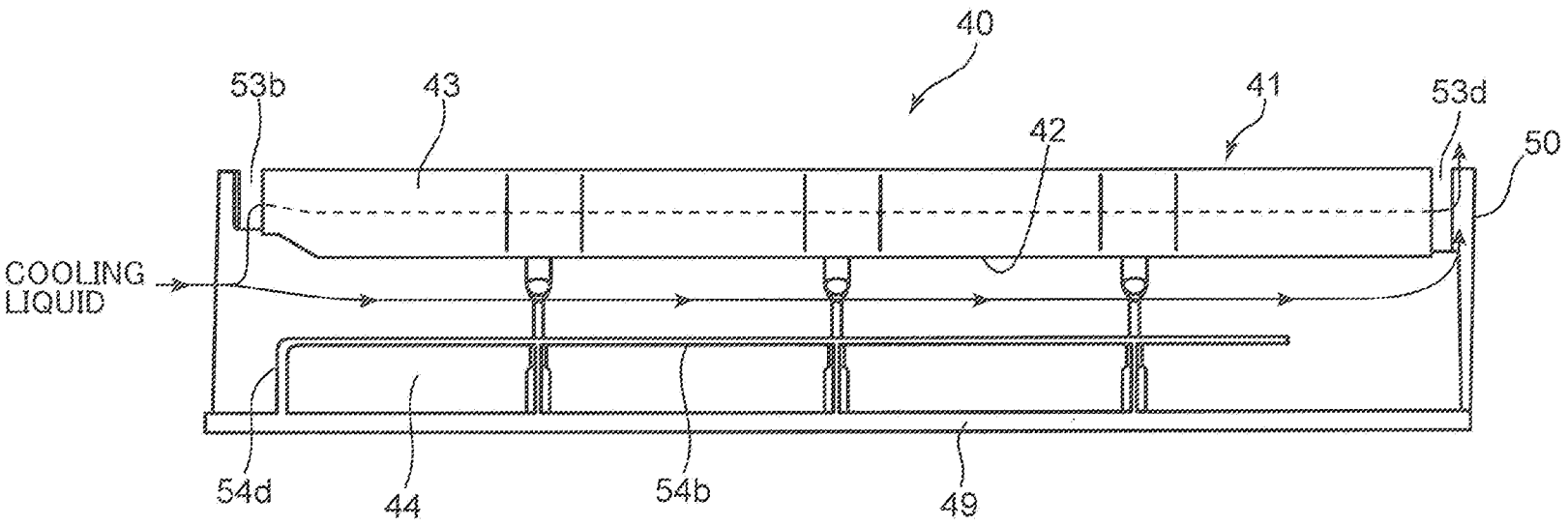
FIG. 5 is a side view of the spacer member when viewed from the intake side.

As illustrated in FIG. 3, FIG. 5 and FIG. 8, the intake-side rib portion 54*b* is formed to project from the outer surface of the intake side portion of the lower wall 44 outwardly in the bore radial direction, and to extend from the introducing portion 36 side toward the discharging portion 37 side along the lower wall 44 at the middle portion of the lower wall 44 in the up-down direction. The intake-side passage 33*d* is formed on the upper side than the intake-side rib portion 54*b*. In other words, the intake-side rib portion 54*b* defines the range of the intake-side passage 33*d* in the up-down direction. The projection height of the intake-side rib portion 54*b* is set substantially equal to a projection amount of the upper wall 43 with respect to the lower wall 44 in the radial direction. According to this configuration, the projection end of the intake-side rib portion 54*b* faces the block outer wall 34 in proximity to or in close contact with the block outer wall 34 in a state that the spacer member 40 is disposed within the block-side jacket 33. In the embodiment, the height position of the intake-side rib portion 54*b* coincides with the middle portion of the cylinders #1 to #4 in the up-down direction.

As illustrated in FIG. 2 and FIG. 4, the tilted rib portion 54*c* is formed to project from the outer surface of the exhaust side portion of the lower wall 44 outwardly in the bore radial direction, and to extend obliquely downwardly from an end of the exhaust-side rib portion 54*a* on the introducing portion 36 side toward an end of the lower end flange 49 on the introducing portion 36 side. The tilt angle of the tilted rib portion 54*c* with respect to a horizontal plane is an acute angle, and is preferably about 45°. In other words, an angle at which the tilted rib portion 54*c* and the exhaust-side rib portion 54*a* intersect with each other is an obtuse angle, and is preferably about 135°.

As illustrated in FIG. 3 and FIG. 5, the vertical rib portion 54*d* is formed to project from the outer surface of the intake side portion of the lower wall 44 outwardly in the bore radial direction, and to extend from an end of the intake-side rib portion 54*b* on the introducing portion 36 side linearly downwardly toward the lower end flange 49 along the central axis of a cylinder.

The tilted rib portion 54*c* and the vertical rib portion 54*d* correspond to one of the elements of the distribution adjustment mechanism of the present invention.

(5) Cylinder Head

As illustrated in FIG. 1, the cylinder head 4 includes the head-side jacket 60 for cooling the periphery of the exhaust ports 7 and the intake ports 8 for the cylinders #1 to #4, and the periphery of a combustion chamber; the exhaust-side introducing port 61*a* and the intake-side introducing port 61*b* formed in the other end of the cylinder head 4 in the cylinder array direction (an end of the cylinder head 4 on the fourth cylinder #4 side) for introducing a cooling liquid discharged from the block-side jacket 33 to the head-side jacket 60; and the discharging portion 62 formed in an end of the cylinder head 4 in the cylinder array direction (an end of the cylinder head 4 on the first cylinder #1 side) for discharging a cooling liquid from the head-side jacket 60 to the external passing members. The exhaust-side introducing port 61*a* and the intake-side introducing port 61*b* communicate with the head-side jacket 60, and also communicate with the block-side jacket 33 via the discharging portion 37 of the cylinder block 3 and via the communication holes 72*a* and 72*b* of the gasket 70.

(6) Water Pump

The water pump 5 is a pump to be forcibly driven by the engine 2. The water pump 5 is mounted on an end of the cylinder block 3 in the cylinder array direction (an end of the cylinder block 3 on the first cylinder #1 side). A pressurized cooling liquid fed from the water pump 5 is introduced to the block-side jacket 33 and the head-side jacket 60. Specifically, the water pump 5 is connected to a crankshaft (not illustrated) of the engine 2, and feeds a pressurized cooling liquid accompanied by rotation of the crankshaft, in other words, accompanied by rotation of the engine 2. Note that in the embodiment, the water pump 5 is disposed on an end of the cylinder block 3 in the cylinder array direction at a position close to the exhaust side.

The guiding portion 22 for guiding a cooling liquid to the block-side jacket 33 is connected to the discharge port of the water pump 5. The guiding portion 22 is a cover member extending from the discharge port of the water pump 5 toward the intake side of the cylinder block 3 for covering a part of a surface of the cylinder block 3. A linear passage extending in the intake-exhaust direction is formed between the guiding portion 22 and an end surface of the cylinder block 3. A midway portion of the passage communicates with the block-side jacket 33 via the exhaust-side introducing portion 36*a* and the intake-side introducing portion 36*b*.

(7) Advantageous Effects of Embodiment

Next, advantageous effects of the engine according to the embodiment are described.

In the embodiment, first of all, as illustrated in FIG. 7, a pressurized cooling liquid fed from the water pump 5 is allowed to flow into the exhaust-side passage 33*c* through the guiding portion 22 and the exhaust-side introducing portion 36*a*, and is allowed to flow into the intake-side passage 33*d* through the guiding portion 22 and the intake-side introducing portion 36*b*.

A cooling liquid flowing into the exhaust-side passage 33*c* through the exhaust-side introducing portion 36*a* impinges against the lower wall 44 of the spacer member 40. Then, a part of the cooling liquid is allowed to flow on the upper side, and is allowed to flow into the exhaust-side passage 33*a* through the exhaust-side opening portion 53*a* (see FIG. 6) toward the discharging portion 37 side. Further, the remaining part of the cooling liquid is allowed to flow toward the discharging portion 37 side through the exhaust-side passage 33*c* (see FIG. 7).

Note that a part of the cooling liquid flowing from the exhaust-side introducing portion 36*a* is allowed to flow toward the intake side, and a part of the cooling liquid flowing from the intake-side introducing portion 36*b* is allowed to flow toward the exhaust side in a region between the exhaust-side introducing portion 36*a* and the intake-side introducing portion 36*b* of the block-side jacket 33 (or in a region between the exhaust-side opening portion 53*a* and the intake-side opening portion 53*b*). However, these streams of cooling liquid are offset from each other. Therefore, substantially no stream of cooling liquid occurs in this region.

A cooling liquid flowing into the intake-side passage 33*d* through the intake-side introducing portion 36*b* impinges against the lower wall 44 of the spacer member 40. Then, a part of the cooling liquid is allowed to flow on the upper side, and is allowed to flow into the intake-side passage 33*b* through the intake-side opening portion 53*b* (see FIG. 6). The remaining part of the cooling liquid is allowed to flow toward the discharging portion 37 side through the intake-side passage 33*d* (see FIG. 7).

In the embodiment, the opening area of the exhaust-side opening portion 53*a* is set larger than the opening area of the intake-side opening portion 53*b* so that a large amount of cooling liquid is allowed to flow through the exhaust-side passage 33*a*, as compared with the intake-side passage 33*b*. This makes it possible to make the flow rate of cooling liquid flowing through the exhaust side passage 33*a* large, as compared with the flow rate of cooling liquid flowing through the intake-side passage 33*b*. Thus, the cooling performance with respect to the exhaust side portion of the cylinder block 3 increases, as compared with the intake side portion of the cylinder block 3.

Further, the lower wall 44 of the spacer member 40 includes the tilted rib portion 54*c*, which extends continuously from an end of the exhaust-side rib portion 54*a* on the introducing portion 36 side obliquely downwardly toward the introducing portion 36 side; and the vertical rib portion 54*d*, which extends continuously from an end of the intake-side rib portion 54*b* on the introducing portion 36 side linearly downwardly along the central axis of a cylinder. This makes it possible to make a resistance exerted on a cooling liquid by the vertical rib portion 54*d* larger than a resistance exerted on a cooling liquid by the tilted rib portion 54*c*. Therefore, it is possible to make the flow rate of cooling liquid flowing through the exhaust-side passage 33*c* large, as compared with the flow rate of cooling liquid flowing through the intake-side passage 33*d*. Thus, the cooling performance with respect to the exhaust side portion of the cylinder block 3 increases, as compared with the intake side portion of the cylinder block 3.

Further, in the embodiment, the partition wall 50 separates the exhaust-side passage 33*a* and the intake-side passage 33*b* from each other, and separates the exhaust-side passage 33*c* and the intake-side passage 33*d* from each other. This makes it possible to prevent a cooling liquid flowing through the intake-side passage 33*b* from interfering with a cooling liquid flowing through the exhaust-side passage 33*a*, and to prevent a cooling liquid flowing through the intake-side passage 33*d* from interfering with a cooling liquid flowing through the exhaust-side passage 33*c*. This is advantageous in allowing a cooling liquid flowing through the exhaust-side passages 33*a* and 33*c*, and the intake-side passage 33*b* and 33*d* to smoothly flow into the head-side jacket 60, respectively.

For instance, a cooling liquid flowing through the exhaust-side passage 33*a* to an end of the spacer member 40 on the discharging portion 37 side impinges against the partition wall 50, and is allowed to flow on the upper side. Further, a cooling liquid flowing through the exhaust-side passage 33*c* to an end of the spacer member 40 on the discharging portion 37 side impinges against the partition wall 50, and is allowed to flow on the upper side. Then, the cooling liquid from the exhaust-side passage 33*a* and the cooling liquid from the exhaust-side passage 33*c* are merged and are allowed to flow to the exhaust-side discharging portion 37*a*. The merged cooling liquid is allowed to flow into the head-side jacket 60 through the communication hole 72*a* of the gasket 70 and through the exhaust-side introducing port 61*a* of the cylinder head 4.

Likewise, a cooling liquid flowing through the intake-side passage 33*b* to an end of the spacer member 40 on the discharging portion 37 side impinges against the partition wall 50, and is allowed to flow on the upper side. Further, a cooling liquid flowing through the intake-side passage 33*d* to an end of the spacer member 40 on the discharging portion 37 side impinges against the partition wall 50, and is allowed to flow on the upper side. Then, the cooling liquid from the intake-side passage 33*b* and the cooling liquid from the intake-side passage 33*d* are merged and are allowed to flow into the intake-side discharging portion 37*b*. The merged cooling liquid is allowed to flow into the head-side jacket 60 through the communication hole 72*b* of the gasket 70 and through the intake-side introducing port 61*b* of the cylinder head 4.

As described above, in the embodiment, the opening area of the exhaust-side opening portion 53*a* formed in the upper wall 43 of the spacer member 40 is larger than the opening area of the intake-side opening portion 53*b* formed in the upper wall 43. Therefore, a cooling liquid is distributed unevenly, and a large amount of cooling liquid is introduced to the exhaust-side passage 33*a*, as compared with the intake-side passage 33*b*. This makes it possible to increase the cooling performance with respect to the exhaust side portion of the cylinder block 3, as compared with the intake side portion of the cylinder block 3. Therefore, it is possible to sufficiently cool a discharge side portion of the cylinder block 3, whose temperature tends to be relatively high, and to suppress a temperature difference between the intake side portion and the exhaust side portion of the cylinder block 3. Consequently, it is possible to suppress an increase in sliding resistance of pistons due to non-uniform deformation of the cylinder bore wall 32. This is advantageous in improving the fuel economy. Further, as described in the embodiment, when a cooling liquid is allowed to flow in a region between the upper wall 43 of the spacer member 40 and the cylinder bore wall 32, the heat of the cylinder bore wall 32 is effectively released by way of the cooling liquid. Therefore, increasing the flow rate of cooling liquid on the exhaust side portion in the region, as compared with the intake side portion in the region is advantageous in suppressing non-uniform deformation of the cylinder bore wall 32.

Further, in the embodiment, separating the exhaust-side passage 33*a* and the intake-side passage 33*b* from each other by the partition wall 50 of the spacer member 40 allows for a cooling liquid flowing through the exhaust-side passage 33*a* and a cooling liquid flowing through the intake-side passage 33*b* to flow into the head-side jacket 60 independently of each other. This makes it possible to prevent streams of cooling liquid flowing from the exhaust-side passage 33*a* to the head-side jacket 60 by being blocked by a cooling liquid flowing through the intake-side passage 33*b*, and to prevent streams of cooling liquid flowing from the intake-side passage 33*b* to the head-side jacket 60 by being blocked by a cooling liquid flowing through the exhaust-side passage 33*a*. Consequently, it is possible to form smooth streams of cooling liquid in the exhaust-side passage 33*a* and in the intake-side passage 33*b*, and to appropriately adjust the distribution amount of cooling liquid between the exhaust-side passage 33*a* and the intake-side passage 33*b*. The same advantageous effects as described above are obtained regarding a cooling liquid flowing through the exhaust-side passage 33*c* and a cooling liquid flowing through the intake-side passage 33*d*.

Further, in the embodiment, causing a cooling liquid to flow inside the upper wall 43 of the spacer member 40, and causing a cooling liquid to flow outside the lower wall 44, which is formed below the upper wall 43, is advantageous in increasing the cooling performance with respect to the upper portion of the cylinder bore wall 32, as compared with the lower portion of the cylinder bore wall 32. This makes it possible to sufficiently cool the upper portion of the cylinder bore wall 32, whose temperature tends to be relatively high, and makes it possible to suppress a temperature difference between the upper portion and the lower portion of the cylinder bore wall 32. Consequently, it is possible to suppress an increase in sliding resistance of pistons due to non-uniform deformation of the cylinder bore wall 32. This is advantageous in improving the fuel economy. Further, as compared with a configuration, in which a cooling liquid is allowed to flow only inside the upper wall 43 of the spacer member 40, the area where a cooling liquid is allowed to flow increases. This is advantageous in reducing a pressure loss when a pressurized cooling liquid is fed to the block-side jacket 33.

Further, in the embodiment, the exhaust-side passage 33*c* is restrictively formed in a region on the upper side than the exhaust-side rib portion 54*a*, and the intake-side passage 33*d* is restrictively formed in a region on the upper side than the intake-side rib portion 54*b*. This is further advantageous in lowering the cooling performance with respect to the lower portion of the cylinder bore wall 32, of which the necessity of cooling is relatively low, and in suppressing a temperature difference between the upper portion and the lower portion of the cylinder bore wall 32.

Further, in the embodiment, a cooling liquid is smoothly guided to the exhaust-side passage 33*c* by the operation of the tilted rib portion 54*c*, and a resistance exerted on a cooling liquid flowing into the intake-side passage 33*d* is increased by the operation of the vertical rib portion 54*d*. This makes it possible to reduce the flow rate of cooling liquid flowing through the intake-side passage 33*d*, as compared with the flow rate of cooling liquid flowing through the exhaust-side passage 33*c*. This is further advantageous in suppressing a temperature difference between the exhaust side portion and the intake side portion of the cylinder block 3.

(8) Modifications

In the embodiment, the introducing portion 36 is constituted by two introducing ports i.e. the exhaust-side introducing portion 36*a* and the intake-side introducing portion 36*b*. Alternatively, the introducing portion 36 may be constituted by a single introducing port. Specifically, an introducing port may be formed at a position lower than the exhaust-side opening portion 53*a* and the intake-side opening portion 53*b*, and at a position facing an intermediate portion between the exhaust-side opening portion 53*a* and the intake-side opening portion 53*b* in the intake-exhaust direction. In this case, a cooling liquid is allowed to flow in a region between the exhaust-side passage 33*c* and the intake-side passage 33*d* through the single introducing port, and a part of the cooling liquid is allowed to flow on the upper side. Thus, a large amount of cooling liquid is allowed to flow into the exhaust-side opening portion 53*a*, as compared with the intake-side opening portion 53*b*. Also in this case, it is possible to effectively cool the exhaust side portion of the cylinder block 3, as compared with the intake side portion of the cylinder block 3.

Further, in the embodiment, the gap L1 between the inner surface of the upper wall 43 and the cylinder bore wall 32 is set to be equal between the exhaust-side passage 33*a* and the intake-side passage 33*b*. Alternatively, the gap may be set large for the exhaust-side passage 33*a*, as compared with the intake-side passage 33*b*. Further, a portion of the step portion 42 on the exhaust side may be formed at a position lower than a portion of the step portion 42 on the intake side to make the passage space of the exhaust-side passage 33*a* large.

Further, in the embodiment, the gap L2 between the outer surface of the lower wall 44 and the block outer wall 34 is set equal to each other between the exhaust-side passage 33*c* and the intake-side passage 33*d*. Alternatively, the gap may be set large for the exhaust-side passage 33*c*, as compared with the intake-side passage 33*d*.

Further, in the embodiment, each of the exhaust-side opening portion 53*a* and the intake-side opening portion 53*b* is formed into a cutout. Alternatively, the middle portion of the upper wall 43 in the up-down direction may be formed into a through-hole in the thickness direction of the upper wall 43. In this case, the opening area of the through-hole is set large for the exhaust side portion of the upper wall 43, as compared with the intake side portion of the upper wall 43.

Further, in the embodiment, the exhaust-side rib portion 54*a* and the intake-side rib portion 54*b* are formed at the middle portion of the lower wall 44 in the up-down direction (namely, a portion of the lower wall 44 where the distance from the upper end of the lower wall 44 and the distance from the lower end of the lower wall 44 are substantially equal to each other). Alternatively, the exhaust-side rib portion 54*a* and the intake-side rib portion 54*b* may be formed at a position closer to the upper side or at a position closer to the lower side.

Further, in the embodiment, the partition wall 50 is disposed at the middle portion of the bulging space portion 35 in the intake-exhaust direction. Alternatively, the distribution amount of cooling liquid with respect to the exhaust side portion may be increased by disposing the partition wall 50 at a position slightly closer to the intake side so that the surface area of the exhaust-side discharging portion 37*a* is made larger than the surface area of the intake-side discharging portion 37*b*.

Further, in the embodiment, an example is described in which the present invention is applied to the in-line 4-cylinder engine 2. The engine to which the present invention is applied is not limited to an in-line engine. The present invention is applicable to various cross-flow engines such as a V-type engine, and a horizontally-opposed engine. The number of cylinders is not limited to four. As far as the number of cylinders is plural, the number other than four may be used. Further, in the embodiment, the engine 2 is disposed in a transverse posture within an engine room formed in a front portion of a vehicle in a state that the cylinder array direction is aligned with the vehicle width direction. Alternatively, the engine may be disposed in a vertical posture in which the cylinder array direction is aligned with the front-rear direction of a vehicle. The engine room may be formed in a front portion of a vehicle, or may be formed in the middle portion of a vehicle, or may be formed in a rear portion of a vehicle.

(9) Summary

The following is a summary of the features of the embodiment.

The embodiment discloses a cooling structure for a multi-cylinder engine including a plurality of cylinders aligned in series. The cooling structure includes a block-side water jacket formed in a cylinder block in such a manner as to surround the plurality of cylinders; a head-side water jacket formed in a cylinder head to be connected to the cylinder block; an introducing portion formed in an end of the cylinder block in the cylinder array direction, and configured to introduce a cooling liquid to the block-side water jacket; a discharging portion formed in the other end of the cylinder block in the cylinder array direction, and configured to discharge the cooling liquid from the block-side water jacket to the head-side water jacket; and a spacer member accommodated in the block-side water jacket in such a manner as to surround a cylinder bore wall defining the plurality of cylinders, and including a peripheral wall facing the cylinder bore wall with a certain gap. An exhaust-side passage and an intake-side passage are formed between the peripheral wall and the cylinder bore wall, the exhaust-side passage located on an exhaust side with respect to the plurality of cylinders and causing a cooling liquid to flow between the introducing portion and the discharging portion, the intake-side passage located on an intake side with respect to the plurality of cylinders and causing a cooling liquid to flow between the introducing portion and the discharging portion. The spacer member includes a distribution adjustment mechanism which distributes a cooling liquid introduced from the introducing portion to the block-side water jacket between the exhaust-side passage and the intake-side passage.

According to the aforementioned configuration, the distribution adjustment mechanism of the spacer member distributes a cooling liquid between the exhaust-side passage and the intake-side passage. Therefore, it is possible to appropriately cool an exhaust side portion and an intake side portion of the cylinder block with a simplified configuration, and to suppress a temperature difference between the intake side portion and the exhaust side portion of the cylinder block. Consequently, it is possible to suppress an increase in sliding resistance of pistons due to non-uniform deformation of the cylinder bore wall. This is advantageous in improving the fuel economy. Further, when a cooling liquid is allowed to flow in a region between the peripheral wall of the spacer member and the cylinder bore wall as described in the aforementioned configuration, it is possible to efficiently release the heat of the cylinder bore wall by way of the cooling liquid. This is advantageous in suppressing non-uniform deformation of the cylinder bore wall.

Preferably, the distribution adjustment mechanism may include an exhaust-side opening portion and an intake-side opening portion in an end of the peripheral wall on a side of the introducing portion in the cylinder array direction, the exhaust-side opening portion communicating with the exhaust-side passage, the intake-side opening portion communicating with the intake-side passage. An opening area of the exhaust-side opening portion may be set larger than an opening area of the intake-side opening portion so that a large amount of cooling liquid is allowed to flow through the exhaust-side passage, as compared with the intake-side passage.

As described above, when the opening area of the exhaust-side opening portion is set larger than the opening area of the intake-side opening portion, the flow rate of cooling liquid flowing through the exhaust-side passage is large, as compared with the flow rate of cooling liquid flowing through the intake-side passage. This makes it possible to increase the cooling performance with respect to the exhaust side portion of the cylinder block, as compared with the cooling performance with respect to the intake side portion of the cylinder block. This is advantageous in suppressing a temperature difference between the intake side portion and the exhaust side portion of the cylinder block.

Preferably, the distribution adjustment mechanism may include a partition wall on an end of the spacer member on a side of the discharging portion in the cylinder array direction, the partition wall separating the exhaust-side passage and the intake-side passage from each other, and separating the discharging portion into an exhaust side portion and an intake side portion.

As described above, when the exhaust-side passage and the intake-side passage are separated from each other, and the discharging portion is separated into the exhaust side portion and the intake side portion by the partition wall formed on the spacer member, a cooling liquid flowing through the exhaust-side passage and a cooling liquid flowing through the intake-side passage are allowed to flow into the head-side water jacket independently of each other. This makes it possible to prevent streams of cooling liquid flowing from the exhaust-side passage to the head-side water jacket from being blocked by a cooling liquid flowing through the intake-side passage, and to prevent streams of cooling liquid flowing from the intake-side passage to the head-side water jacket from being blocked by a cooling liquid flowing through the exhaust-side passage. Consequently, it is possible to form smooth streams of cooling liquid in the exhaust-side passage and in the intake-side passage. This is advantageous in appropriately adjusting the distribution amount of cooling liquid between the exhaust-side passage and the intake-side passage.

Preferably, the peripheral wall may be formed in such a manner as to surround an upper portion of the cylinder bore wall. The spacer member may include a lower wall formed at a position lower than the peripheral wall and facing an outer wall of the block-side water jacket with a certain gap. A lower exhaust-side passage and a lower intake-side passage may be formed between the lower wall and the outer wall, the lower exhaust-side passage located on the exhaust side with respect to the plurality of cylinders and communicating with the introducing portion, the lower intake-side passage located on the intake side with respect to the plurality of cylinders and communicating with the introducing portion.

According to the aforementioned configuration, causing a cooling liquid to flow inside the peripheral wall of the spacer member, and causing a cooling liquid to flow outside the lower wall formed at a position lower than the peripheral wall makes it possible to increase the cooling performance with respect to the upper portion of the cylinder bore wall, as compared with the cooling performance with respect to the lower portion of the cylinder bore wall. This makes it possible to sufficiently cool the upper portion of the cylinder bore wall, whose temperature tends to be relatively high, and to suppress a temperature difference between the upper portion and the lower portion of the cylinder bore wall. Consequently, this is advantageous in suppressing an increase in sliding resistance of pistons due to non-uniform deformation of the cylinder bore wall, and in improving the fuel economy. Further, as compared with a configuration, in which a cooling liquid is allowed to flow only inside the peripheral wall of the spacer member, the area where a cooling liquid is allowed to flow increases. This makes it possible to reduce a pressure loss when a pressurized cooling liquid is fed to the block-side water jacket.

In the aforementioned configuration, more preferably, the spacer member may include a rib portion projecting from an outer surface of the lower wall outwardly in a bore radial direction and extending from a side of the introducing portion toward a side of the discharging portion to define the lower intake-side passage and the lower exhaust-side passage. The rib portion may be formed in such a manner that the lower intake-side passage and the lower exhaust-side passage are restrictively formed in a region on an upper side than the rib portion.

According to the aforementioned configuration, the region where a cooling liquid is allowed to flow is restricted to the region on the upper side than the rib portion. This is further advantageous in lowering the cooling performance with respect to the lower portion of the cylinder bore wall, of which the necessity of cooling is relatively low, and in suppressing a temperature difference between the upper portion and the lower portion of the cylinder bore wall.

In the aforementioned configuration, more preferably, the rib portion may include an exhaust-side rib portion located on the exhaust side, and an intake-side rib portion located on the intake side. The distribution adjustment mechanism may include a vertical rib portion extending from an end of the intake-side rib portion on the introducing portion side downwardly along a central axis of the cylinder, and projecting outwardly in the bore radial direction from the outer surface of the lower wall, and a tilted rib portion extending obliquely downwardly from an end of the exhaust-side rib portion on the introducing portion side, and projecting outwardly in the bore radial direction from the outer surface of the lower wall.

According to the aforementioned configuration, a cooling liquid is smoothly guided to the lower exhaust-side passage by the operation of the tilted rib portion, and a resistance exerted on a cooling liquid flowing through the lower intake-side passage is increased by the operation of the vertical rib portion. This makes it possible to reduce the flow rate of cooling liquid flowing through the lower intake-side passage, as compared with the flow rate of cooling liquid flowing through the lower exhaust-side passage. This is further advantageous in suppressing a temperature difference between the exhaust side portion and the intake-side portion of the cylinder block.

This application is based on Japanese Patent Application No. 2015-247890 filed in Japan Patent Office on Dec. 18, 2015, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A cooling structure for a multi-cylinder engine comprising:

a plurality of cylinders aligned in series along a direction to form a cylinder array;

a block-side water jacket formed in a cylinder block in such a manner as to surround the plurality of cylinders;

a head-side water jacket formed in a cylinder head to be connected to the cylinder block;

an introducing port formed in a first end of the cylinder block in the cylinder array direction, and configured to introduce a cooling liquid to the block-side water jacket;

a discharging opening formed in a second, opposite end of the cylinder block in the cylinder array direction, and configured to discharge the cooling liquid from the block-side water jacket to the head-side water jacket;

a spacer member accommodated in the block-side water jacket in such a manner as to surround a cylinder bore wall defining the plurality of cylinders, an upper wall formed in a upper region of the spacer member, and the upper wall is facing the cylinder bore wall with a certain gap;

an exhaust-side passage and an intake-side passage formed between the upper wall and the cylinder bore wall, the exhaust-side passage located on an exhaust side with respect to the plurality of cylinders and causing a cooling liquid to flow between the introducing port and the discharging opening, the intake-side passage located on an intake side with respect to the plurality of cylinders and causing a cooling liquid to flow between the introducing port and the discharging opening, and an exhaust-side opening and an intake-side opening formed in an end of the upper wall in the cylinder array direction, the exhaust-side opening and the intake-side opening positioned such that the cooling liquid from the introducing port flows through each of the exhaust-side opening and the intake-side opening in a direction that is toward the cylinder bore wall.

2. The cooling structure for a multi-cylinder engine according to claim 1, wherein the distribution adjustment mechanism includes a partition wall on an end of the spacer member on a side of the discharging opening in the cylinder array direction, the partition wall separating the exhaust-side passage and the intake-side passage from each other, and separating the discharging opening into an exhaust side portion and an intake side portion.

3. The cooling structure for a multi-cylinder engine according to claim 1, wherein the upper wall is formed in such a manner as to surround an upper portion of the cylinder bore wall, the spacer member includes a lower wall formed at a position lower than the upper wall and facing an outer wall of the block-side water jacket with a certain gap, and a lower exhaust-side passage and a lower intake-side passage are formed between the lower wall and the outer wall, the lower exhaust-side passage located on the exhaust side with respect to the plurality of cylinders and communicating with the introducing port, the lower intake-side passage located on the intake side with respect to the plurality of cylinders and communicating with the introducing port.

4. The cooling structure for a multi-cylinder engine according to claim 3, wherein the spacer member includes a rib portion projecting from an outer surface of the lower wall outwardly in a bore radial direction and extending from a side of the introducing port toward a side of the discharging opening to define the lower intake-side passage and the lower exhaust-side passage, and the rib portion is formed in such a manner that the lower intake-side passage and the lower exhaust-side passage are restrictively formed in a region on an upper side than the rib portion.

5. The cooling structure for a multi-cylinder engine according to claim 4, wherein the rib portion includes an exhaust-side rib portion located on the exhaust side, and an intake-side rib portion located on the intake side, and the distribution adjustment mechanism includes a vertical rib portion extending from an end of the intake-side rib portion on the introducing port side downwardly along a central axis of the cylinder, and projecting outwardly in the bore radial direction from the outer surface of the lower wall, and a tilted rib portion extending obliquely downwardly from an end of the exhaust-side rib portion on the introducing port side, and projecting outwardly in the bore radial direction from the outer surface of the lower wall.

6. A cooling structure for a multi-cylinder engine comprising:

a plurality of cylinders aligned in series along a direction to form a cylinder array;

a block-side water jacket formed between an outer surface of a cylinder bore wall defining the plurality of cylinders and an inner surface of a block outer wall in such a manner as to surround the plurality of cylinders;

a head-side water jacket formed in a cylinder head to be connected to the cylinder block;

an introducing port formed in a first end of the cylinder block in the cylinder array direction, and configured to introduce a cooling liquid to the block-side water jacket;

a discharging opening formed in a second, opposite end of the cylinder block in the cylinder array direction, and configured to discharge the cooling liquid from the block-side water jacket to the head-side water jacket;

a spacer member accommodated in the block-side water jacket in such a manner as to surround the cylinder bore wall, the spacer member including an upper wall and a lower wall, the lower wall formed below the upper wall, and a first gap between the upper wall and the cylinder bore wall is larger than a second gap between the lower wall and the cylinder bore wall;

an exhaust-side passage and an intake-side passage formed between the upper wall and the cylinder bore wall, the exhaust-side passage located on an exhaust side with respect to the plurality of cylinders and causing a cooling liquid to flow between the introducing port and the discharging opening, the intake-side passage located on an intake side with respect to the plurality of cylinders and causing a cooling liquid to flow between the introducing port and the discharging opening;

a lower exhaust-side passage and a lower intake-side passage are formed between the lower wall and the block outer wall, the lower exhaust-side passage located on an exhaust side with respect to the plurality of cylinders and causing a cooling liquid to flow between the introducing port and the discharging opening, the lower intake-side passage located on an intake side with respect to the plurality of cylinders and causing a cooling liquid to flow between the introducing port and the discharging opening; and the upper wall has an opening at the end of the upper wall in the cylinder array direction, and the opening is located on an upper side than introducing port.

7. The cooling structure for a multi-cylinder engine according to claim 1, the exhaust-side opening and the intake-side opening positioned on opposite sides of a line extending through a center of the plurality of cylinders when viewing the plurality of cylinders in a planar view.

8. The cooling structure for a multi-cylinder engine according to claim 1, wherein an opening area of the exhaust-side opening is set larger than an opening area of the intake-side opening.

9. The cooling structure for a multi-cylinder engine according to claim 6, wherein a width of the exhaust-side passage and the lower intake-side passage is larger than the second gap.

10. The cooling structure for a multi-cylinder engine according to claim 6, wherein a width of the exhaust-side passage and the lower intake-side passage is larger than the second gap.

11. The cooling structure for a multi-cylinder engine according to claim 10, wherein a third gap between the block outer wall and the upper wall is smaller than the first gap.

12. The cooling structure for a multi-cylinder engine according to claim 10, wherein the spacer member includes a step portion, the step portion extending radially inward from a lower end of the upper wall to an upper end of the lower wall continuing to an inner end of the step portion.

13. The cooling structure for a multi-cylinder engine according to claim 1, wherein the discharging opening includes an intake-side discharging opening and an exhaust-side discharging opening divided by a partition wall formed in the second, opposite end of the spacer member.

14. The cooling structure for a multi-cylinder engine according to claim 6, wherein the discharging opening includes an intake-side discharging opening and an exhaust-side discharging opening divided by a partition wall formed in the second, opposite end of the spacer member.

* * * * *